United States Patent [19]

Ueno et al.

[11] 4,088,178

[45] May 9, 1978

[54] VERTICAL DIE CASTING MACHINES

[75] Inventors: Toyoaki Ueno, Yamaguchi; Masashi Uchida, Ube, both of Japan

[73] Assignee: Ube Industries, Ltd., Ube, Japan

[21] Appl. No.: 765,505

[22] Filed: Feb. 3, 1977

[51] Int. Cl.[2] ..... B22D 17/00

[52] U.S. Cl. ..... 164/314; 164/312

[58] Field of Search ..... 164/303, 312, 313, 314, 164/136

[56] References Cited

U.S. PATENT DOCUMENTS 2,454,961 11/1948 Booth ..... 164/303 X

FOREIGN PATENT DOCUMENTS 133,133 10/1951 Sweden ..... 164/314

*Primary Examiner*—Richard B. Lazarus

*Attorney, Agent, or Firm*—Townsend and Townsend

[57] ABSTRACT

In a vertical die casting machine of the type wherein molten metal contained in a vertical casting sleeve located beneath a stationary platen is cast into a die cavity defined between a stationary die and a movable die urged against the stationary die, the casting sleeve is divided into an upper and a lower part. The upper casting sleeve is secured to the stationary platen in communication with the die cavity. The lower casting sleeve is normally held in vertical alignment with the upper casting sleeve but is moved to a position lateral to the stationary platen for receiving the molten metal. When the lower casting sleeve is returned to the normal vertical position it is urged against the upper casting sleeve and molten metal in the lower casting sleeve is teemed and cast into the die cavity by operating an injection plunger.

6 Claims, 10 Drawing Figures

VERTICAL DIE CASTING MACHINES

BACKGROUND OF THE INVENTION

This invention relates to a vertical die casting machine.

Although a vertical die casting machine has an excellent characteristic, its application is limited due to its construction, especially by the fact that it includes a number of component parts which are difficult to maintain in good operating condition. Thus, according to one prior art vertical die casting machine, once set on a stationary platen, the casting sleeve and the stationary or lower die cannot be readily removed except when replacing these members so that it is necessary to teem molten metal through the parting plane of the upper and lower dies. Accordingly, overflown molten metal or foreign matter tends to accumulate in the lower die, thus damaging the same. Moreover, as it is necessary to clean the dies and to apply a lubricant before teeming, and to clamp the dies and insert a core after completion of the teeming, the time of the operating cycle is prolonged. Consequently, the temperature of the molten metal decreases, thereby degrading the quality of the cast product.

Considering the relationship between the operation cycle time and the temperature of the molten metal, there are two contradictory relationships, that is, in order to improve the quality of the product, the temperature of the molten metal should be high; whereas to improve the production speed, it is necessary to decrease the temperature of the molten metal so as to accelerate the solidification thereof.

In other words, where high quality is important, on the one hand, the productivity is left out of consideration; and where the productivity is important, on the other hand, the quality is degraded. Such contradictory conditions are inevitable in a vertical die casting machine. According to a prior art design, however, a preference is given to the productivity and therefore, for the purpose of preventing an excessive temperature rise of the casting sleeve, means for cooling the entirety of the same has been provided. In consequence, the solid phase of the molten metal increases, thus degrading the quality of the product.

SUMMARY OF THE INVENTION

Accordingly, it is an object of this invention to provide an improved vertical die casting machine which is easy to maintain, has a high productivity and does not degrade the quality of the products produced.

Another object of this invention is to provide an improved vertical die casting machine in which it is not necessary to teem the molten metal into the casting sleeve from above the satationary die, thereby improving the quality of the product and making easy to clean the dies and to apply thereon a lubricant.

According to this invention, there is provided a vertical die casting machine of the type comprising a stationary platen, a stationary die secured to the stationary platen, a movable die, means mounted on the stationary platen for urging the movable die against the stationary die thereby defining a die cavity therebetween, in which the vertical die casting machine is provided with an upper casting sleeve secured to the stationary platen and communicating with the die cavity, a lower casting sleeve normally held in vertical alignment with the upper casting sleeve, an injection plunger contained in the lower casting sleeve, means for causing the lower casting sleeve to engage and disengage the upper casting sleeve, a supporting member for supporting the lower casting sleeve when it is disengaged from the upper casting sleeve, means for moving the lower casting sleeve between its normal position in which it is held in vertical alignment with the upper casting sleeve and a position lateral to the stationary platen, means for pouring molten metal into the lower casting sleeve when it is maintained at the lateral position, and means for operating the injection plunger for casting the molten metal into the die cavity.

The lower casting sleeve is inclined or moved in the horizontal direction to the lateral position.

BRIEF DESCRIPTION OF THE DRAWINGS

Other objects and advantages of the invention can be more fully understood from the following detailed description taken in conjunction with the accompanying drawings in which.

DESCRIPTION OF THE PREFERRED EMBODIMENTS

Figure 1:
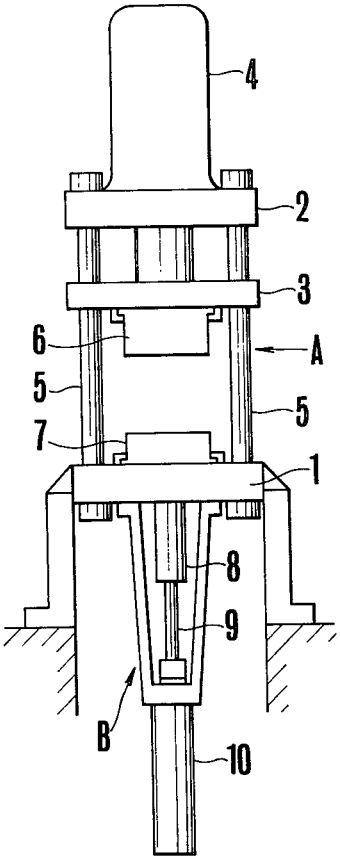
FIG.1 (PRIOR ART)
FIG. 1 is a diagrammatic fron view showing one example of a prior art vertical die casting machine.

Prior to the description of the invention, a typical prior art vertical die casting machine will be described firstly with reference to FIG. 1, show a machine comprising a die clamping unit A and an injection unit B. These units are constituted by stationary platens 1 and 2, a movable platen 3, a die clamping cylinder 4, columns 5 for guiding the movable platen 3, a movable die 6 carried by the movable platen 3, a stationary die 7 secured to the stationary platen 1, a casting sleeve 8, an injection plunger 9 operating in the casting sleeve, and a pressurized oil cylinder 10 for actuating the injection plunger. Although a vertical die casting machine of the type described above can produce products having higher quality than a horizontal type die casting machine, it is disadvantageous in that its productivity is low, that is its operation cycle time is long. One reason for this lies in the fact that since the casting sleeve 8, injection plunger 9, stationary platen 1 and stationary die 7 are integrally combined, it is necessary to teem the molten metal through the parting plane between the stationary and the movable dies by moving a ladle 11 and a hopper 12 with a movable bracket 13 in the directions shown by arrows after the movable die 6 has been raised. For this reason, there are the following disadvantages as has been pointed out hereinabove:

1. Since the teeming devices 11, 12 and 13 are moved in the space between the movable and stationary dies 6 and 7, the overflown molten metal or foreign matter tends to accumulate in the stationary die 7 thereby damaging the same.

2. Prior to the teeming, it is necessary to clean the dies and to apply thereon a lubricant and after teeming, it is necessary to clamp the dies and to insert a core, which not only prolongs the operation cycle time but also decreases the temperature of the molten metal.

Figure 3:
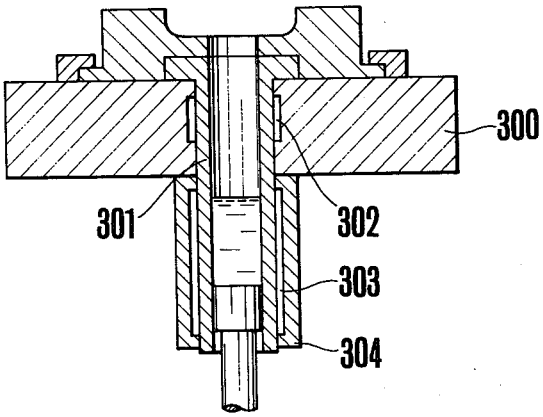
FIG.3 (PRIOR ART)
FIG. 3 is a longitudinal sectional view of a portion of another prior art vertical die cast machine.

In another prior art vertical die casting machine, for the purpose of preventing excess temperature rise in the casting sleeve and enhancing solidification of the molten metal thereby improving the productivity, as shown in FIG. 3, a cooling cavity 302 is provided inside the stationary platen 300 to surround the casting sleeve 301 for cooling the upper portion thereof, and an outer sleeve 304 formed with a cooling cavity 303 is mounted on the casting sleeve 301 thereby cooling the entire length thereof. With this construction, however, the solid phase of the molten metal increases with the result that the quality of the product decreases.

Figure 2:
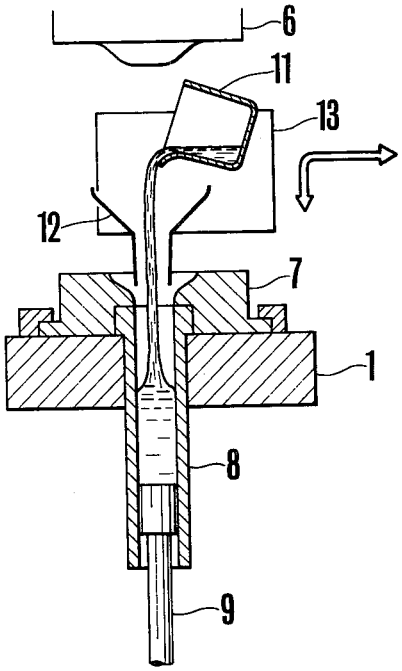
FIG.2 (PRIOR ART)
FIG. 2 is a longitudinal sectional view of a portion of the machine shown in FIG. 1.
Figures 4A, 4B:
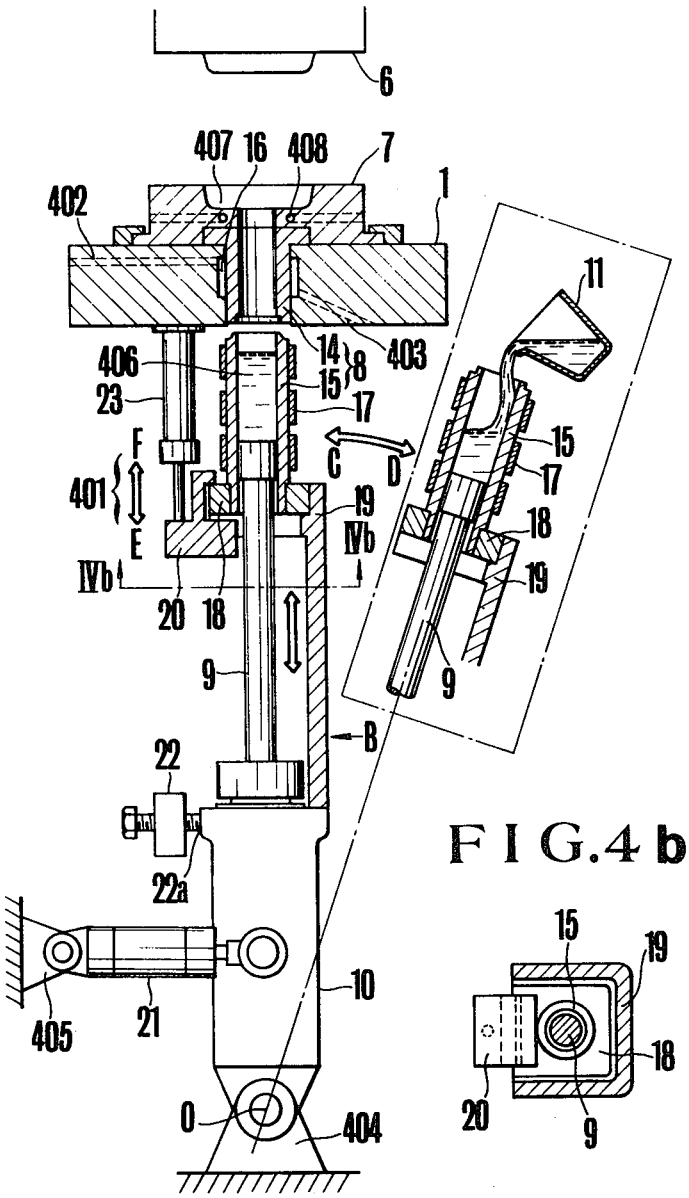
FIG. 4*a* is a longitudinal sectional view of one embodiment of the vertical die casting machine of this invention.
FIG. 4*b* is a cross-sectional view taken along a line $IV_b$ — $IV_b$ shown in FIG. 4*a;*

FIG. 4*a* shows a longitudinal sectional view of an improved vertical die casting machine constructed in accordance with this invention, especially the injection unit thereof, in which the elements corresponding to those shown in FIGS. 1 and 2 are designated by the same reference numerals. In this embodiment, the casting sleeve 8 is divided into an upper sleeve 14 secured to the stationary platen 1 and a movable lower sleeve 15. A cooling cavity 16 in communication with a water supply conduit 402 and a water exhaust conduit 403 is formed to surround the upper sleeve 14 for maintaining the same at a low temperature. The stationary die 7 is also provided with a cooling conduit 408. On the outer periphery of the lower sleeve 15 is mounted a heating device 17 for maintaining the lower sleeve at a high temperature. The injection plunger 9 is contained in the lower sleeve 15 and the lower end of the injection sleeve is connected to the piston rod of an injection cylinder 10 having its lower end pivotally mounted on a pedestal 404 secured to the machine frame. The lower end of the upper sleeve 14 and the upper end of the lower sleeve 15 are removably connected by a faucet joint. A ring 18 is snugly fit on the lower end of the lower sleeve 15. When lower sleeve 15 is separated from the upper sleeve 14, the lower position of the lower sleeve 15 is determined by the upper end of a support 19 secured to the injection cylinder 10. On the other hand, the ring 18 is engaged by an operating member 20 operated by a vertical shift cylinder 23 secured to the lower surface of the stationary platen 1 for moving the lower sleeve 15 in the vertical direction. This construction permits the removal of the lower sleeve in the horizontal direction as shown by an arrow C-D. Such ready removal can be more fully understood from FIG. 4*b* showing a bottom view of the portion 401.

The injection cylinder 10 is tilted about an axis 0 by a tilting pressurized oil cylinder 21 which is pivotally mounted on a pedestal 405 secured to the machine frame. The injection position of the injection cylinder 10 is determined by the end 22*a* of a stopper 22.

In operation, the lower sleeve 15 is maintained at the inclined position by tilting the injection piston 10. At this position, the upper end of the lower sleeve 15 is located at a position lateral to the stationary platen 1 so that it is possible to pour the molten metal into the lower sleeve 15 from the ladle 11. Then the injection unit B is tilted back to the vertical position by tilting cylinder 21. At this time, the shift cylinder 23 is operated in the vertical direction E-F for urging the lower sleeve 15 against the upper sleeve 14 through the operating member 20. Of course, it should be understood that the cleaning of the upper and lower dies 6 and 7, application of the lubricant, insertion of a core, not shown, and the clamping of the dies have been completed by this time. Thus, immediately after the engagement of the upper and lower sleeves 14 and 15, the injection cylinder 10 is operated to raise the injection plunger for casting the molten metal (see FIG. 6).

Generally, it takes about 4 to 10 seconds between the pouring of the molten metal 406 into the lower sleeve 15 and the casting of the molten metal so that the molten metal cools and begins to solidify unless the lower sleeve 15 and the molten metal 406 contained therein are warmed or heated. For this reason, the heating device 17, for example an electric heating unit, is energized during this interval for preventing the solidification of the molten metal. If desired, a switch, not shown, in series with the heating device may be on-off controlled according to the program of the pouring and casting of the molten metal.

Figure 6:
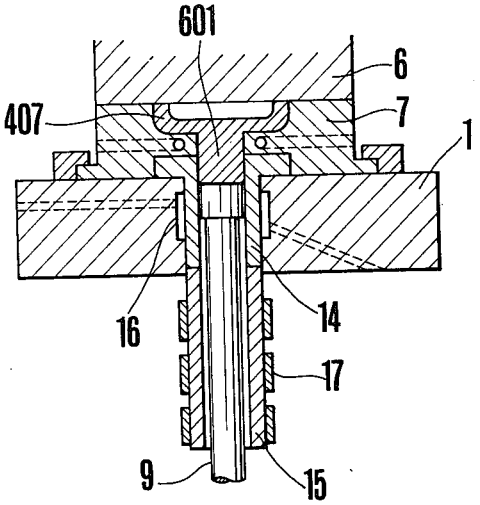
FIG. 6 is a longitudinal sectional view of the die after casting the molten metal and FIG. 7 is a longitudinal sectional view showing a portion of still another embodiment of this invention.

When the injection plunger 9 is rapidly raised, the molten metal is filled into the cavity 407 of the dies 6 and 7 through the cooled upper sleeve 14, but as shown in FIG. 6, a portion of the molten metal is caused to remain in the upper portion of the upper sleeve 14 to form a biscuit 601 acting as a dead head. Under these conditions, it is necessary to cool the dead head or the biscuit 601 for the purpose of increasing the producting speed. In other words, by forming a dead head in the upper sleeve 14 it is possible to improve the cooling of the casting. Such cooling can efficiently be performed by cooling the upper sleeve 14 and by heating the lower sleeve 15.

Although the molten metal passes through the cooled upper sleeve 14 during casting, as the casting speed is extremely high, the time during which the molten metal passes through the cooled upper sleeve is very short, of the order only 0.1 second so that the degree of cooling of the molten metal is negligibly small.

Upon completion of the cooling of the cast product, the movable die 6 is raised. Concurrently therewith the injection plunger 9 is raised further to eject the product out of the lower die 7 together with the biscuit. Thereafter the injection plunger 9 and the piston of the shift cylinder 23 are lowered. Then, the tilting cylinder 21 is operated to tilt the injection unit B thus completing one cycle.

Figure 5A:
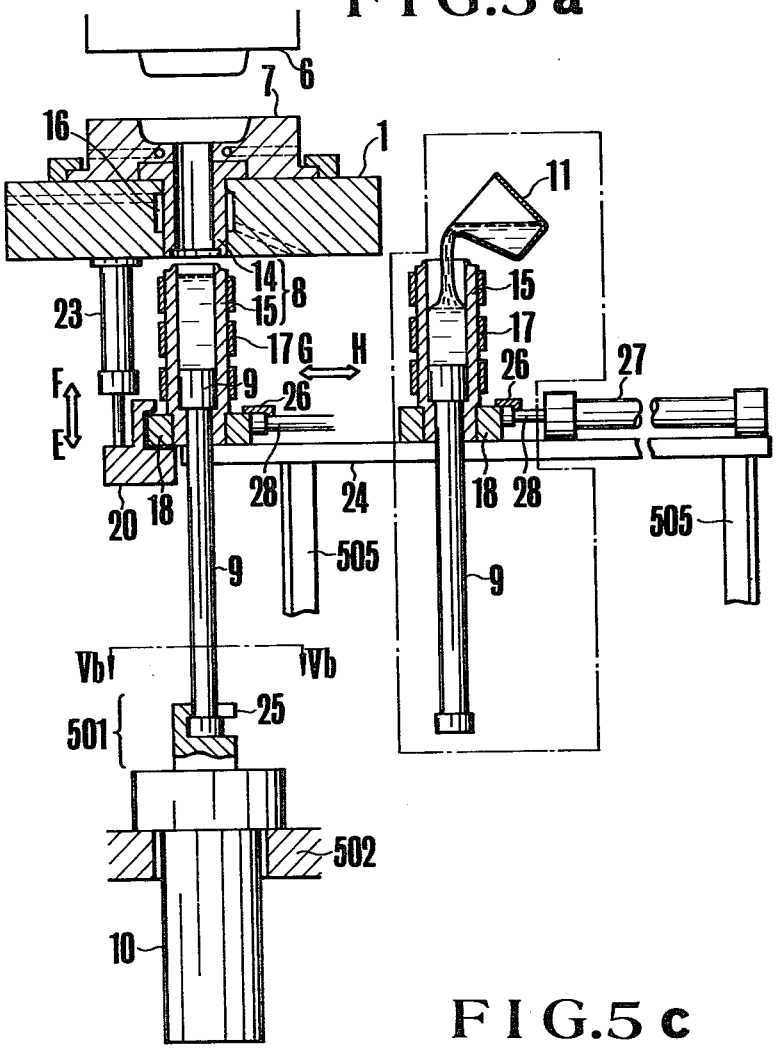
FIG. 5*a* is a longitudinal sectional view showing a modification of this invention.

FIG. 5*a* shows a modified embodiment of this invention in which the lower sleeve containing the injection plunger 9 is movable in the horizontal direction along a horizontal guide plate or rail 24 via the ring 18. The assembly is moved to a pouring position bounded by phantom lines by means of an oil pressure cylinder 27 at which time the lower end of the injection plunger 9 disengages a coupling member 25 mounted on the injection cylinder 10 which is supported by a support 502. A coupling 26 between the ring 18 and the piston rod 28 of the oil pressure cylinder 27 secured to the guide rail 24 is constructed to permit relative vertical movement between the ring and the piston rod.

Figure 5B:
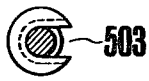
FIG. 5*b* is a cross-sectional view taken along a line $V_b$ — $V_b$ shown in FIG. 5*a;*
Figure 5C:
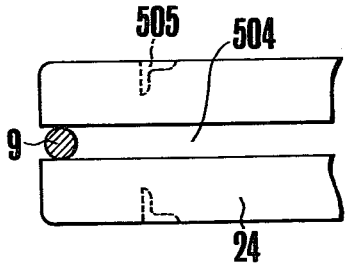
FIG. 5*c* is a plan view showing the guide plate utilized in the modification shown in FIG. 5*a;*

As shown in FIG. 5*b*, the coupling member 25 is provided with a notch for permitting the horizontal movement of the lower end of the injection plunger 9 and for accommodating the enlarged bottom end of the injection plunger. Further, as shown in FIG. 5*c*, the guide rail 24 is formed by a flat plate including a guide groove 504 for receiving the injection plunger 9 and angle members 505 for securing the guide rail to the machine.

The modified embodiment shown in FIG. 5*a* operates as follows. While the injection unit is held at the right-hand pouring position at which the upper end of the lower sleeve 15 is remote from the stationary platen 1, the molten metal is poured into the lower sleeve 15. Then the oil pressure cylinder 27 is actuated to bring the lower sleeve 15 to a position immediately beneath the upper sleeve 14. Thereafter, the molten metal in the lower sleeve 15 is teemed and cast into the dies in the same manner as has been described in connection with the first embodiment.

In both embodiments, when the shift cylinder 23 is operated to separate the lower sleeve 15 from the upper sleeve 14, the lower sleeve 15 is displaced from the upper sleeve 14 by operating the tilting cylinder 21 or the oil pressure cylinder 27 and the molten metal is poured into the lower sleeve. Then the lower sleeve 15 is brought back into vertical alignment with the upper sleeve 14 by operating the tilting cylinder 21 or the oil pressure cylinder 27, and the lower sleeve is urged against the upper sleeve by operating the shift cylinder 23. After lowering the upper die, the injection cylinder 10 is operated to teem and cast the molten metal into the die cavity defined by the dies. After the cast metal has solidified, the upper die 6 is raised and the injection plunger 9 is raised further to eject the cast product thus completing one cycle. In consequence, the upper die may be lowered by the time when the shift cylinder 23 is operated to raise the lower sleeve, so that it is possible to clean the dies and to apply the lubricant thereon during an interval between the lowering of the injection plunger 9 and the raising of the piston of the shift cylinder 23, thereby greatly shortening the operation cycle time. Such a series of steps can be performed by a well known programmed control or by a manual or automatic control or a combination thereof. The timing of the steps is immaterial to the invention so that is is believed unnecessary to describe it in detail.

Figure 7:
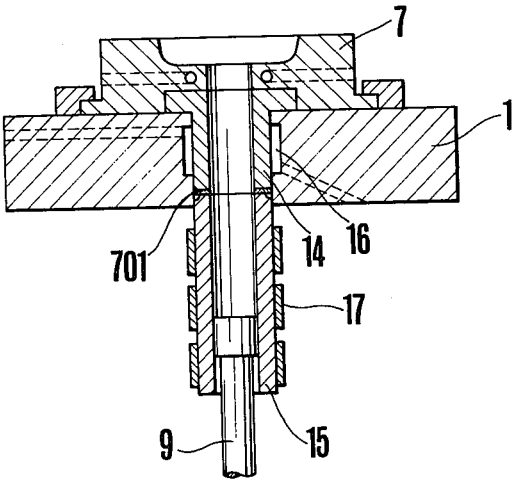

FIG. 7 shows a modified casting sleeve wherein a thermal insulating member 701 is interposed between the upper sleeve 14 and the lower sleeve 15 for improving the cooling effect for the upper sleeve 14 and the heating effect for the lower sleeve 15. The thermal insulating member 701 may be provided for either one or both of the upper and lower sleeves.

As above described, according to this invention the molten metal is poured into the lower sleeve while it is maintained at a position on the lateral side of the stationary platen and then the upper and lower sleeves are combined integrally to teem and cast the molten metal so that it is possible to insert the core and to clamp the dies during the pouring operation whereby the operation time cycle can be reduced. Moreover, as it is possible to independently control the cooling of the upper sleeve and the heating of the lower sleeve, the dead head or biscuit formed after casting, can be efficiently cooled which improves the production speed and the quality of the product.

Further, as the molten metal is not poured immediately above the lower die, there is no fear of damaging the same.

We claim:

1. In a vertical die casting machine of the type comprising a stationary platen, a stationary die secured to said stationary platen, a movable die, means mounted on said stationary platen for urging said movable die against said stationary die thereby defining a die cavity therebetween, the improvement which comprises an upper casting sleeve having an axis and being secured to said stationary platen and communicating with said die cavity, a lower casting sleeve having an axis and being normally held in vertical axial alignment with said upper casting sleeve, an injection plunger contained in said lower casting sleeve, means for causing motion of said lower casting sleeve with respect to said upper casting sleeve along the aligned axes to engage and disengage said sleeves, a supporting member for supporting said lower casting sleeve when it is disengaged from said upper casting sleeve, means for tilting said lower casting sleeve between its normal position in which said lower casting sleeve is held in vertical alignment with said upper casting sleeve and a position laterally disposed from said stationary platen, means for pouring molten metal into said lower casting sleeve when it is maintained at said lateral position, and first fluid pressure cylinder means pivotally connected to a stationary structure for operating said injection plunger for casting said molten metal into said die cavity, said tilting means including a second fluid pressure cylinder coupled to said first fluid pressure cylinder and a stationary structure.

2. The vertical die casting machine according to claim 1 which further comprises a support mounted on said first fluid pressure cylinder for supporting said lower casting sleeve when it is disengaged from said upper casting sleeve.

3. The vertical die casting machine according to claim 1 wherein said means for causing said lower casting sleeve to engage and disengage said upper casting sleeve comprises a third fluid pressure cylinder connected between said stationary platen and said lower casting sleeve.

4. The vertical die casting machine according to claim 1 which further comprises means for cooling said upper casting sleeve.

5. The vertical die casting machine according to claim 1 which further comprises means for heating said lower casting plunger.

6. The vertical die casting machine according to claim 1 which further comprises a thermal insulating member provided between the abutting end of said upper and lower casting sleeves.

* * * * *